US010596611B2

(12) United States Patent
Nishimura et al.

(10) Patent No.: US 10,596,611 B2
(45) Date of Patent: Mar. 24, 2020

(54) METHOD FOR PRODUCING PRESS-FORMED PRODUCT

(71) Applicant: NIPPON STEEL & SUMITOMO METAL CORPORATION, Tokyo (JP)

(72) Inventors: Ryuichi Nishimura, Tokyo (JP); Yoshiaki Nakazawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/085,628

(22) PCT Filed: Mar. 28, 2017

(86) PCT No.: PCT/JP2017/012609
§ 371 (c)(1),
(2) Date: Sep. 17, 2018

(87) PCT Pub. No.: WO2017/170533
PCT Pub. Date: Oct. 5, 2017

(65) Prior Publication Data

US 2019/0030583 A1 Jan. 31, 2019

(30) Foreign Application Priority Data

Mar. 28, 2016 (JP) ..... 2016-063058

(51) Int. Cl.
*B21D 5/01* (2006.01)
*B21D 22/26* (2006.01)
(Continued)

(52) U.S. Cl.
CPC ..... *B21D 5/01* (2013.01); *B21D 5/002* (2013.01); *B21D 22/02* (2013.01); *B21D 22/22* (2013.01);
(Continued)

(58) Field of Classification Search
CPC ..... B21D 5/01; B21D 22/02; B21D 22/04; B21D 22/22; B21D 22/26; B21D 37/10
See application file for complete search history.

(56) References Cited

U.S. PATENT DOCUMENTS

2015/0224563 A1* 8/2015 Aso ..... B21D 22/26 428/595
2015/0360272 A1* 12/2015 Fujii ..... B21D 22/26 72/343

FOREIGN PATENT DOCUMENTS

CN 104903020 9/2015
JP 2006-289480 10/2006
(Continued)

*Primary Examiner* — Teresa M Ekiert
(74) *Attorney, Agent, or Firm* — Clark & Brody

(57) ABSTRACT

A production method includes a placement step, a first pressing step, and a second pressing step. In the placement step, a blank plate is placed in press tooling. In the first pressing step, the blank plate is caused to undergo bend forming in such a way that concave ridges, a concave area, and areas of concave-correspondence vertical wall areas that are areas adjacent to the concave ridges are formed in the blank plate. In the second pressing step, the resultant plate is caused to undergo draw forming in such a way that convex ridges, a convex area, areas of convex-correspondence vertical wall areas that are areas adjacent to the convex ridges are formed in the resultant plate.

6 Claims, 9 Drawing Sheets

(51) Int. Cl.

| | |
|---|---|
| ***B21D 24/00*** | (2006.01) |
| ***B21D 5/00*** | (2006.01) |
| ***B21D 22/02*** | (2006.01) |
| ***B21D 22/22*** | (2006.01) |
| ***B21D 37/10*** | (2006.01) |
| ***B21D 24/04*** | (2006.01) |

(52) U.S. Cl.
CPC ..... *B21D 22/26* (2013.01); *B21D 24/005* (2013.01); *B21D 37/10* (2013.01); *B21D 24/04* (2013.01)

(56) References Cited

FOREIGN PATENT DOCUMENTS

| | | |
|---|---|---|
| JP | 2016-002560 | 1/2016 |
| WO | 2014/042067 | 3/2014 |
| WO | 2014/050973 | 4/2014 |

* cited by examiner

METHOD FOR PRODUCING PRESS-FORMED PRODUCT

TECHNICAL FIELD

The present disclosure relates to a method for producing a press-formed product formed of a steel plate.

BACKGROUND ART

A frame part of an automobile is a press-formed product having a hat-shaped or groove-shaped cross section in many cases. The press-formed product includes a top plate section and two vertical wall sections. In an exact sense, a press-formed product having a hat-shaped cross section further includes two flange sections. Press-formed products have a variety of shapes. An example of a press-formed product having a complicated shape is a press-formed product including a top plate section that rises and falls along the longitudinal direction thereof. The press-formed product is configured such that the top plate section has a concave area curved inward in a side view and a convex area curved outward in the side view with the concave and convex areas continuous with each other in the longitudinal direction of the press-formed product.

To produce a press-formed product having such a complicated shape, a soft steel plate or a 440 MPa-class high-tension steel plate (these plates are hereinafter also collectively referred to as a "low-strength steel plate") is mainly used as a blank plate. The tensile strength (TS) of a 440 MPa-class high-tension steel plate is 440 MPa or more, and the yield strength (YP) thereof is about 350 MPa or more. When a low-strength blank steel plate is formed in press forming into a press-formed product having a complicated shape, occurrence of wrinkles is a concern. Conventional press forming is therefore primarily draw forming (see WO 2014/042067 (Patent Literature 1), for example). A reason for this is that occurrence of wrinkles can be avoided in draw forming because the forming advances with tension applied to the blank plate. Bend forming for shape fixation is performed as the last process.

In recent years, an automobile is required to have improved fuel consumption from the viewpoint of global environment preservation. To this end, each frame part of an automobile is encouraged to have a reduced weight. From the circumstances described above, a 590 MPa-class high-tension steel plate (hereinafter also referred to as "mid-strength steel plate") having a small plate thickness tends to be used as a blank plate of a press-formed product used as a frame part. Further, a 980 MPa-class high-tension steel plate (hereinafter also referred to as "high-strength steel plate") having a smaller plate thickness tends to be used as the blank plate. The tensile strength (TS) of a 590 MPa-class high-tension steel plate is 590 MPa or more, and the yield strength (YP) thereof is about 400 MPa or more. The tensile strength (TS) of a 980 MPa-class high-tension steel plate is 980 MPa or more, and the yield strength (YP) thereof is about 600 MPa or more.

However, when a press-formed product having a complicated shape is formed in press forming from a mid-strength blank steel plate, and the press forming is primarily draw forming as described above, excessive tension occurs in some cases in the vicinity of a ridge present between the convex area of the top plate section and each of the vertical wall sections. The plate thickness of the blank plate therefore decreases in the vicinity of the ridges, resulting in breakage of the press-formed product in some cases. Further, compressive stress in the longitudinal direction of the blank plate is induced in the concave area of the top plate section. The material in the vicinity of the concave area of the top plate section therefore gathers, resulting in occurrence of wrinkles.

If the primary part of the press forming is replaced with bend forming using a pad, an excessive decrease in the plate thickness in the vicinity of the ridges adjacent to the convex area of the top plate section is avoided. Wrinkles, however, occur in convex-correspondence vertical wall areas (part of vertical wall sections) extending from the convex area of the top plate section and the concave area of the top plate section. In the case of a hat-shaped press-formed product, wrinkles occur also in convex-correspondence flange areas (part of flange sections) extending from the convex-correspondence vertical wall areas. A reason for this is that in the press forming, the material of the vertical wall sections and the flange sections that are not restricted by the press tooling moves toward the convex area.

That is, it is difficult in typical draw forming and bend forming to form a press-formed product having a complicated shape. Such a situation occurs in a more prominent manner in the case where a high-strength steel plate is used as the blank plate. A reason for this is that the ductility of a high-strength steel plate is further smaller than the ductility of a mid-strength steel plate.

CITATION LIST

Patent Literature

Patent Literature 1: WO 2014/042067

SUMMARY OF INVENTION

Technical Problem

The present disclosure has been made in view of the problem described above. An objective of the present disclosure is to provide a press-formed product producing method capable of avoiding occurrence of wrinkles when a press-formed product including a top plate section that rises and falls along the longitudinal direction thereof is produced.

Solution to Problem

A press-formed product producing method according to an embodiment of the present disclosure is applied to production of a press-formed product including two ridges, a top plate section, and two vertical wall sections. The top plate section is located between the two ridges. The two vertical wall sections extend from the top plate section via the ridges. The two ridges each have a concave ridge convexly curved toward an inner side of the corresponding vertical wall section and a convex ridge convexly curved toward an outer side of the corresponding vertical wall section. A linear distance between a center of each of the concave ridges and a center of the corresponding convex ridge is 15 times a spacing between the two ridges or less. The top plate section has a concave area located between the concave ridges and a convex area located between the convex ridges. The vertical wall sections have concave-correspondence vertical wall areas adjacent to the concave ridges and convex-correspondence vertical wall areas adjacent to the convex ridges. The production method includes a placement step, a first pressing step, and a second pressing step. The placement step is the step of placing a blank metal plate in such a way that the blank metal plate extends off opposite sides of a vertex of a first punch. The first pressing step is the step of causing the blank plate to undergo bend forming by using the first punch, a pad, and a first die in such a way that the concave ridges, the concave area, and areas of the concave-correspondence vertical wall areas that are areas adjacent to the concave ridges are formed in the blank plate to produce an intermediate formed product. The second pressing step is the step of causing the intermediate formed product to undergo draw forming by using a second punch, a second die, and a blank holder in such a way that the convex ridges, the convex area, areas of the convex-correspondence vertical wall areas that are areas adjacent to the convex ridges are formed in the intermediate formed product.

Advantageous Effects of Invention

The press-formed product producing method according to the embodiment of the present disclosure is capable of avoiding occurrence of wrinkles when a press-formed product including a top plate section that rises and falls along the longitudinal direction thereof is produced.

DESCRIPTION OF EMBODIMENTS

Figure 1A:
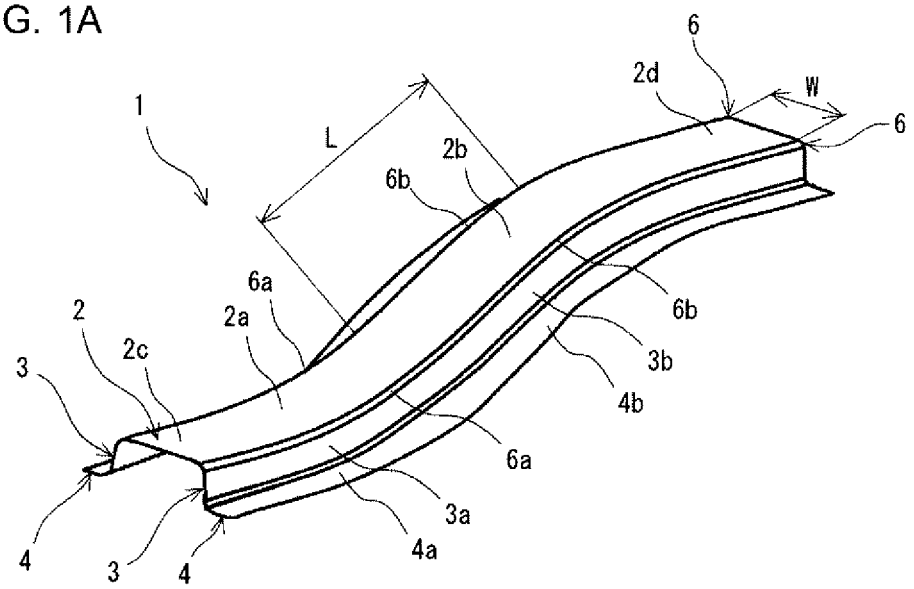
FIG. 1A is a perspective view showing an example of a press-formed product produced by using a production method according to an embodiment of the present invention.

A press-formed product producing method according to an embodiment of the present invention is applied to production of a press-formed product including two ridges, a top plate section, and two vertical wall sections. The top plate section is located between the two ridges. The two vertical wall sections extend from the top plate section via the ridges. The two ridges each have a concave ridge convexly curved toward the inner side of the corresponding vertical wall section and a convex ridge convexly curved toward the outer side of the corresponding vertical wall section. That is, the press-formed product produced by the production method according to the present embodiment has a hat-shaped or groove-shaped cross section and including the top plate section that rises and falls along the longitudinal direction thereof. The longitudinal direction means the direction of a straight line that connects the centers of the edges of the top plate section on opposite ends where no ridge is present to each other. In an exact sense, a press-formed product having a hat-shaped cross section further includes two flange sections extending from the vertical wall sections. A press-formed product having such a complicated shape is used, for example, as a frame part of an automobile (examples: front-side member rear, rear-side member, cross member, upper member, and B pillar).

The top plate section has a concave area located between the concave ridges and a convex area located between the convex ridges. In a typical example of the top plate section of the press-formed product in the present embodiment, one concave area and one convex area are provided. The concave area and the convex area may not be adjacent to each other as long as the concave area and the convex area are smoothly continuous with each other. For example, a flat area having a short length in the longitudinal direction may be present between the concave area and the convex area. It is, however, noted that the linear distance between the center of each of the concave ridges and the center of the corresponding convex ridge is 15 times the spacing between the two ridges or less. A flat area may be provided in each end portion of the top plate section. The top plate section may not have a fixed width. For example, the width of the top plate section may gently change.

The vertical wall sections have concave-correspondence vertical wall areas adjacent to the concave ridges and convex-correspondence vertical wall areas adjacent to the convex ridges. In a typical example of the vertical wall sections of the press-formed product in the present embodiment, the height of the vertical wall sections (size of vertical wall sections in direction perpendicular to top plate section) is fixed over the entire area of the vertical wall sections. The vertical wall sections may, however, not have a fixed height. For example, the height of the vertical wall sections may gently change. In a typical example of flange sections of the press-formed product in the present embodiment, the width of the flange sections is fixed over the entire area of the flange sections. The flange sections may, however, not have a fixed width. For example, the width of the flange sections may gently change.

The production method according to the present embodiment includes a placement step, a first pressing step, and a second pressing step. In the placement step, a blank metal plate is placed to extend off opposite sides of the vertex of a first punch.

In the first pressing step, the blank plate is caused to undergo bend forming by using the first punch, a pad, and a first die. The bend forming produces an intermediate formed product having at least the concave ridges, the concave area, and areas of the concave-correspondence vertical wall areas that are areas adjacent to the concave ridges. The intermediate formed product is also formed to have a convex/concave shape of the top plate section from the convex area to the concave area. To produce a press-formed product having a hat-shaped cross section, concave-correspondence flange areas extending from the concave-correspondence vertical wall areas are further formed out of the areas of the flange sections. In the second pressing step, the intermediate formed product produced in the first pressing step is caused to undergo draw forming by using a second punch, a second die, and a blank holder. The convex ridges, the convex area, areas of the convex-correspondence vertical wall areas that are areas adjacent to the convex ridges are thus formed in the intermediate formed product. To produce a press-formed product having a hat-shaped cross section, convex-correspondence flange areas extending from the convex-correspondence vertical wall areas are further formed out of the areas of the flange sections.

In the production method according to the present embodiment, the vertical walls of the press-formed product are categorized into concave-correspondence vertical walls and convex-correspondence vertical walls. In the case where the press-formed product includes the flanges, the concave-correspondence vertical walls and the concave-correspondence flange areas are collectively called "concave-correspondence areas," and the convex-correspondence vertical walls and the convex-correspondence flange areas are collectively called "convex-correspondence areas." The area of the top plate section from the convex area to the concave area and the concave-correspondence vertical walls or the concave-correspondence areas are first formed in the first pressing step, and the convex area of the top plate section and the convex-correspondence vertical walls or the convex-correspondence areas are then formed in the second pressing step.

According to the thus configured production method, since the first pressing step, which is first carried out, is bend forming using the pad, no wrinkle occurs on the concave area of the top plate section or the concave-correspondence areas. In this process, the area corresponding to the convex-correspondence areas is smoothly continuous with the convex area. No wrinkle therefore occurs in the area corresponding to the convex-correspondence areas. Since the second pressing step, which is then carried out, is draw forming performed with tension applied to the blank plate, no wrinkle occurs in the convex-correspondence areas. At this point, the concave-correspondence areas have been already created by the first pressing step carried out before. No wrinkle therefore occurs in the concave-correspondence areas. Therefore, in the production method according to the present embodiment, occurrence of wrinkles can be avoided in the production of the press-formed product having a hat-shaped or groove-shaped cross section and including the top plate section that rises and falls along the longitudinal direction thereof. A reason why wrinkles occur in a case where the order of the first and second pressing steps is reversed will be described later.

In the production method described above, conditions expressed by the following Formulae (1) to (5) are preferably satisfied:

$$(Ra/\theta a)\times 0.03\times(650/YP)\times(t/1.8)^2<Ha<250 \quad (1);$$

$$15<\theta a<85 \quad (2);$$

$$(Rb/\theta b)\times 0.02\times(650/YP)\times(t/1.8)^2<Hb<250 \quad (3);$$

$$15<\theta b<85 \quad (4); \text{ and}$$

$$40<L<16\times(Ha+Hb)/2\times(650/YP)\times(t/1.8)^2 \quad (5),$$

where symbols in Formulae described above mean as follows:

YP [MPa] represents the yield strength of the blank plate;

t [mm] represents the plate thickness of the blank plate;

Ra [mm] represents the radius of curvature of the concave ridges in a plane containing the direction perpendicular to the top plate section and the longitudinal direction of the top plate section;

θa [°] represents the central angle of the concave ridges in the plane containing the direction perpendicular to the top plate section and the longitudinal direction of the top plate section;

Ha [mm] represents the height of the concave-correspondence vertical wall areas at the center of the concave ridges in the direction perpendicular to the top plate section;

Rb [mm] represents the radius of curvature of the convex ridges in the plane containing the direction perpendicular to the top plate section and the longitudinal direction of the top plate section;

θb [°] represents the central angle of the convex ridges in the plane containing the direction perpendicular to the top plate section and the longitudinal direction of the top plate section;

Hb [mm] represents the height of the convex-correspondence vertical wall areas at the center of the convex ridges in the direction perpendicular to the top plate section; and L [mm] represents the linear distance from the center of each of the concave ridges to the center of the corresponding convex ridge.

In a case where Formulae (1) and (2) described above are satisfied, and conventional press forming that is primarily draw forming is employed, wrinkles occur in the convex area of the top plate section. In a case where Formulae (3) and (4) described above are satisfied, and conventional press forming that is primarily bend forming using a pad is employed, wrinkles occur in the convex-correspondence vertical wall areas and the convex-correspondence flange areas. Further, the wrinkles occur in a case where the condition expressed by Formula (5) described above is satisfied. The production method according to the present embodiment can prevent occurrence of the wrinkles.

In the production method described above, in a case where the height of the concave-correspondence vertical wall areas or the convex-correspondence vertical wall areas of the press-formed product produced in the second pressing step is smaller than the height of desired vertical wall areas of the press-formed product, the production method can include a third pressing step. In the third pressing step, bend forming is performed after the second pressing step to move second ridges of the vertical wall sections toward the outer side of the vertical wall sections, the second ridges located in positions opposite the ridges. In the third pressing step, press tooling including a punch and a die may be further provided with a pad.

In the production method described above, the blank plate formed of a steel plate having yield strength of 400 MPa or more can be used in the forming. In a typical example, the steel plate having yield strength (YP) of 400 MPa or more is a 590 MPa-class high-tension steel plate (mid-strength steel plate having tensile strength (TS) of 590 MPa or more). The blank plate may more preferably have yield strength of 600 MPa or more. In a typical example, the steel plate having yield strength (YP) of 600 MPa or more is a 980 MPa-class high-tension steel plate (high-strength steel plate having tensile strength (TS) of 980 MPa or more). When the yield strength of the blank plate is 400 MPa or more, the amount of out-of-plane deformation increases in the press forming, and the material therefore tends to gather. That is, wrinkles tend to occur. The production method according to the present embodiment is particularly effective in forming a blank plate that tends to cause occurrence of wrinkles into a press-formed product having a complicated shape. Further, when the yield strength of the blank plate is 400 MPa or more, the part performance of the press-formed product is improved.

In the production method described above, even a blank plate having the plate thickness ranging from 0.8 to 1.6 mm can be formed. When the plate thickness of the blank plate is 1.6 mm or less, the amount of out-of-plane deformation increases in the press forming, and the material therefore tends to gather. That is, wrinkles tend to occur. When the plate thickness of the blank plate smaller than 0.8 mm, the impact characteristic and rigidity the press-formed product as a frame part is required to have are unlikely to be satisfied because the blank plate is too thin. On the other hand, when the plate thickness of the blank plate is greater than 1.6 mm, the weight of the press-formed product is unlikely to be greatly reduced because the blank plate is too thick.

In the production method described above, the following Formula (6) is preferably satisfied:

$$0.011<t/W<0.032 \quad (6)$$

where symbols in the Formula mean as follows:

W [mm] represents the spacing between the two ridges. In a case where the condition expressed by Formula (6) is satisfied, wrinkles particularly tend to occur in press forming. The production method according to the present embodiment is particularly suitable for production of such a press-formed product.

The method for producing a press-formed product according to an embodiment of the present invention will be described below in detail.

[Press-Formed Product]

Figure 1B:
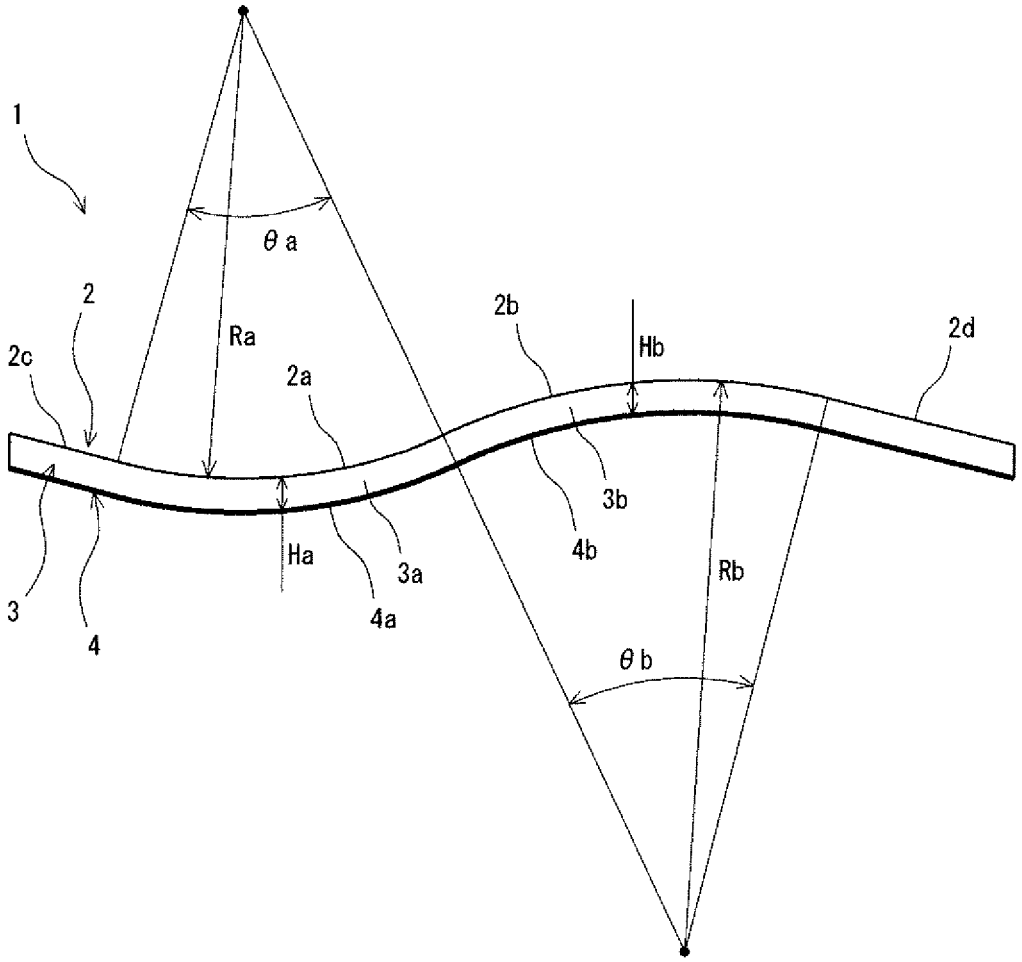
FIG. 1B is a side view of the press-formed product shown in FIG. 1A.

FIGS. 1A and 1B show an example of a press-formed product produced by using the production method according to the embodiment of the present invention. FIG. 1A is a perspective view, and FIG. 1B is a side view. FIGS. 1A and 1B show, by way of example, a press-formed product 1 used as a front-side member rear, which is one of the frame parts of an automobile. The press-formed product 1 has a hat-shaped cross section over the entire area in the longitudinal direction. The press-formed product 1 includes two ridges 6, a top plate section 2, two vertical wall sections 3, and two flange sections 4. The top plate section 2 is located between the two ridges 6. The vertical wall sections 3 extend from the top plate section 2 via the ridges 6. That is, vertical wall sections 3 extend from the opposite sides of the top plate section 2. The flange sections 4 extend from the respective vertical wall sections 3.

The two ridges 6 each have a concave ridge 6*a* and a convex ridge 6*b*. The concave ridge 6*a* is convexly curved toward the inner side of the corresponding vertical wall section 3. The convex ridge 6*b* is convexly curved toward the outer side of the corresponding vertical wall section 3.

The linear distance L between the center of the concave ridge 6*a* and the center of the convex ridge 6*b* is 15 times the spacing W between the two ridges 6 (width of top plate section 2) or less. In short, the concave ridge 6*a* is not excessively separate from the convex ridge 6*b*. If the concave ridge 6*a* and the convex ridge 6*b* are separate from each other by an excessive distance, the press-formed product can be formed with no wrinkle even in conventional press forming.

The top plate section 2 has one concave area 2*a* and one convex area 2*b*. The concave area 2*a* is located between the two concave ridges 6*a*. The convex area 2*b* is located between the two convex ridges 6*b*. The concave area 2*a* is convexly curved toward the inner side of the vertical wall sections 3, as shown in FIG. 1B, which is the side view. The side view means that the press-formed product is viewed in the direction parallel to the top plate section 2 and perpendicular to the longitudinal direction thereof. The top plate section 2 may have a flat area 2*c* continuous with the concave area 2*a*. Similarly, the top plate section 2 may have a flat area 2*d* continuous with the convex area 2*b*. The flat areas 2*c* and 2*d* may extend to the longitudinal ends of the top plate section 2. That is, the press-formed product 1 in the present embodiment includes the top plate section 2 that rises and falls along the longitudinal direction thereof.

The vertical wall sections 3 each have a concave-correspondence vertical wall area 3*a* and a convex-correspondence vertical wall area 3*b*. The flange sections 4 each have a concave-correspondence flange area 4*a* and a convex-correspondence flange area 4*b*. The concave-correspondence vertical wall areas 3*a* extend from the concave area 2*a* of the top plate section 2 via the ridges 6. The concave-correspondence vertical wall areas 3*a* are adjacent to the concave ridges 6*a*. The concave-correspondence flange areas 4*a* extend from the concave-correspondence vertical wall areas 3*a*. The convex-correspondence vertical wall areas 3*b* extend from the convex area 2*b* of the top plate section 2 via the ridges 6. The convex-correspondence vertical wall areas 3*b* are adjacent to the convex ridges 6*b*. The convex-correspondence flange areas 4*b* extend from the convex-correspondence vertical wall areas 3*b*.

That is, the press-formed product 1 in the present embodiment has shape dimensions that cause wrinkles to occur when conventional press forming, which is primarily draw forming or bend forming using a pad, is employed.

[Production of Press-Formed Product]

Figure 2A:
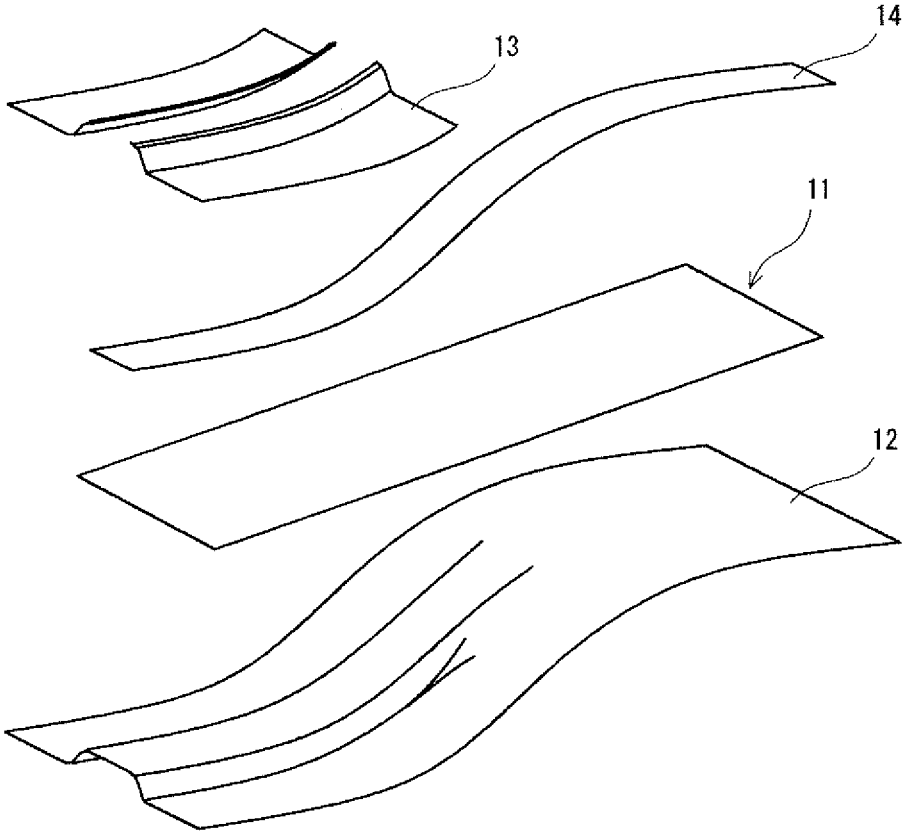
FIG. 2A is a perspective view for describing of a first pressing step of the production method according to the present embodiment.
Figure 2B:
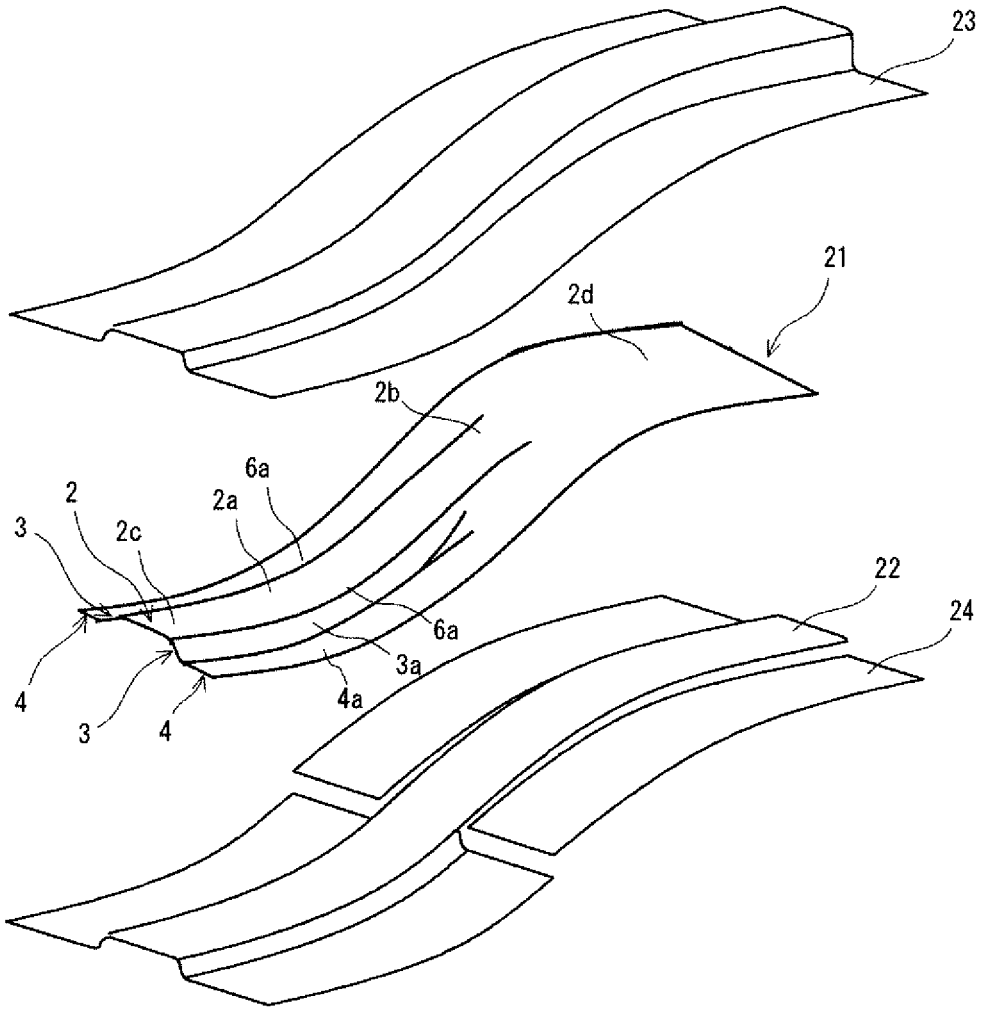
FIG. 2B is a perspective view for describing situation of a second pressing step after the first pressing step.
Figure 2C:
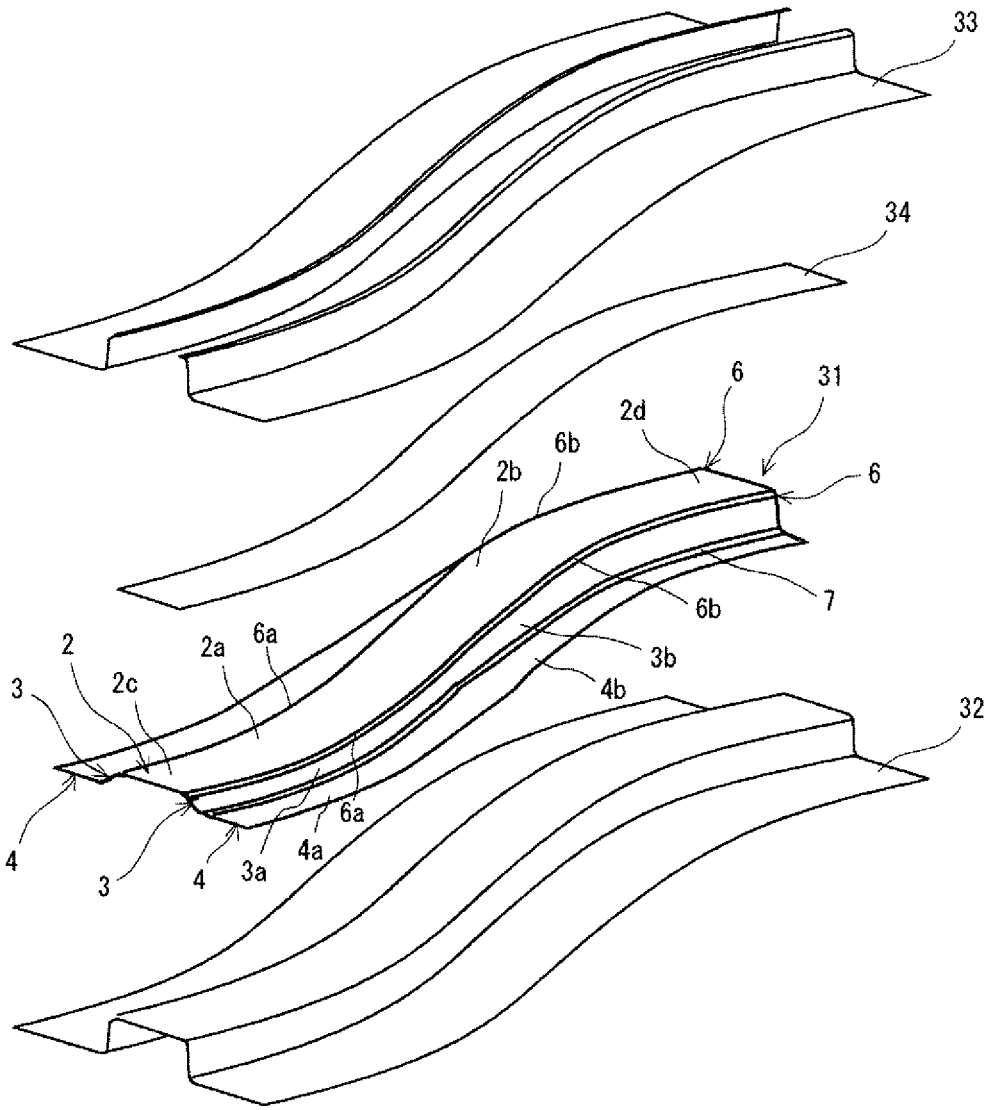
FIG. 2C is a perspective view for describing situation of a third pressing step after the second pressing step.
Figure 3A:
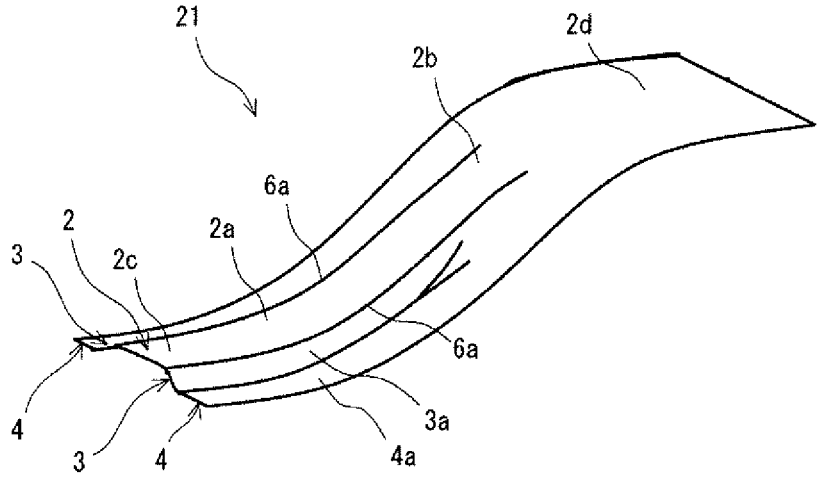
FIG. 3A is a perspective view showing the exterior appearance of an intermediate formed product after the first pressing step.
Figure 3B:
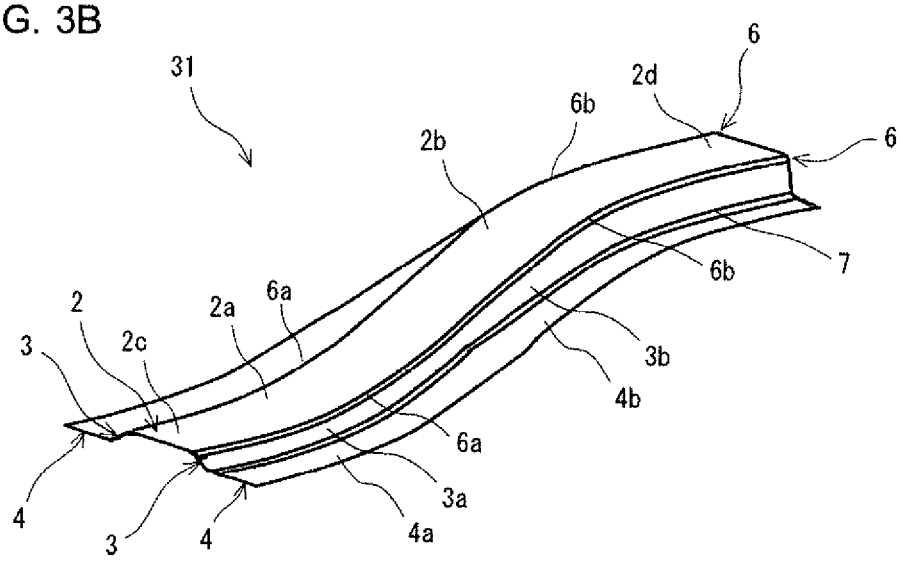
FIG. 3B is a perspective view showing the exterior appearance of the intermediate formed product after the second pressing step.
Figure 3C:
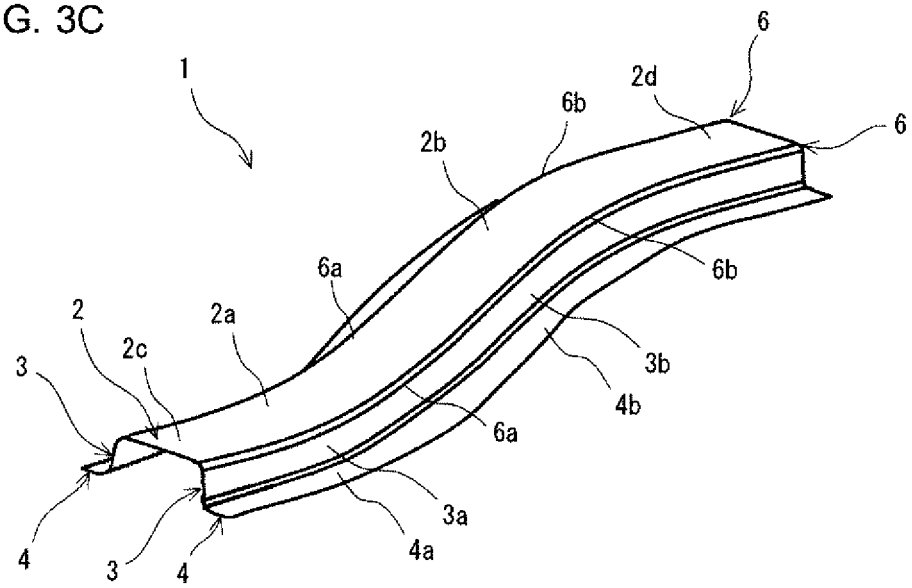
FIG. 3C is a perspective view showing the exterior appearance of the press-formed product after the third pressing step.

FIGS. 2A to 2C are perspective views for describing of the steps of the production method according to a present embodiment. FIG. 2A shows situation of a first pressing step. FIG. 2B shows situation of a second pressing step. FIG. 2C shows situation of a third pressing step. In any of FIGS. 2A to 2C, a blank plate 11 and an intermediate formed product 21 each have a state before the press forming in the corresponding steps. FIG. 3A is a perspective view showing the exterior appearance of the intermediate formed product 21 after the first pressing step. FIG. 3B is a perspective view showing the exterior appearance of an intermediate formed product 31 after the second pressing step. FIG. 3C is a perspective view showing the exterior appearance of the press-formed product 1 after the third pressing step. In any of FIGS. 2A to 2C, forming press tooling is drawn in such a way that only the shape of the surface that comes into contact with the press-formed product is shown for ease of understanding of the configuration of the forming press tooling.

The production method according to the present embodiment includes a placement step, the first pressing step, the second pressing step, and the third pressing step. In the placement step, the blank plate 11, which is a flat plate, is prepared, as shown in FIG. 2A. The blank plate 11 is a plate cut off, for example, a 590 MPa-class high-tension steel plate. The shape of the blank plate 11 is determined in accordance with the shape of the press-formed product 1 (see FIG. 3C).

Next, in the first pressing step, a first press apparatus is used, as shown in FIG. 2A. The first press apparatus includes a first punch 12 as a lower die set and a first die 13 and a first pad 14 as an upper die set.

The first punch 12 reflects the convex/concave shape of the area of the top plate section 2 from the convex area to the concave area. The first punch 12 further reflects the shape of the concave-correspondence vertical wall areas 3*a* out of the areas of the vertical wall sections 3. In the case where the press-formed product includes the flange sections 4, the first punch 12 reflects the shape of the concave-correspondence flange areas 4*a* out of the areas of the flange sections 4. Further, the first punch 12 is configured such that the portion corresponding to the convex-correspondence vertical wall areas 3*b* and the convex-correspondence flange areas 4*b* is a smooth portion continuous with the portion corresponding to the convex area 2*b*.

The first pad 14 reflects the convex/concave shape of the area of the top plate section 2 from the convex area to the concave area. The first die 13 is disposed to face part of the first punch 12. The first die 13 reflects the shape of the concave-correspondence vertical wall areas 3*a* out of the areas of the vertical wall sections 3 and further reflects the shape of the concave-correspondence flange areas 4*a* out of the areas of the flange sections 4. The first die 13 further reflects the shape of the area corresponding to the flat area 2C out of the areas of the vertical wall sections 3 and the flange section 4. In the present embodiment, the height of the shape of the concave-correspondence vertical wall areas 3*a* that the first punch 12 and the first die 13 reflect is set to be smaller than the height of the concave-correspondence vertical wall areas 3*a* of the press-formed product 1, which is the final product, in anticipation of the third pressing step, which will be described later.

The placement step is first carried out. In the placement step, the blank plate 11 formed of a metal plate is placed between the upper die set (first die) and the lower die set (first punch). More specifically, the blank plate 11 is placed to extend off the opposite sides of the vertex of the first punch 12. The portions that extend off are portions formed into the vertical walls or the flanges. The blank plate 11 is produced, for example, by stamping the metal plate. The metal plate is made, for example, of a steel plate, aluminum, an aluminum alloy, or any other substance.

The first pressing step is subsequently carried out. In the first pressing step, the first press apparatus is used to cause the blank plate 11 to undergo bend forming. The first pad 14 is lowered to push the first pad 14 against the blank plate 11 on the first punch 12. The convex/concave shape of the area of the top plate section 2 from the convex area to the concave area is thus formed. The first die 13 is then lowered with the first pad 14 pushed against the blank plate 11 on the first punch 12. The concave ridges 6*a*, the concave area 2*a* of the top plate section 2, areas of the concave-correspondence vertical wall areas 3*a* that are the areas adjacent to the concave ridges 6*a*, and the concave-correspondence flange areas 4*a* are thus formed. At the same time, the area corresponding to the flat area 2*c* out of the areas of the vertical wall sections 3 and the flange sections 4 is formed.

The first pressing step described above produces the intermediate formed product 21 in a first stage shown in FIG. 3A. The intermediate formed product 21 after the first pressing step has the following formed portions: the entire area of the top plate section 2; the concave-correspondence vertical wall areas 3*a* out of the areas of the vertical wall sections 3; the concave-correspondence flange areas 4*a* out of the areas of the flange sections 4; and the area corresponding to the flat area 2*c* out of the areas of the vertical wall sections 3 and the flange sections 4. In the present embodiment, the height of the concave-correspondence vertical wall areas 3*a* of the intermediate formed product 21 after the first pressing step is slightly smaller than the height of the concave-correspondence vertical wall areas 3*a* of the press-formed product 1, which is the final product. Therefore, in the first pressing step, areas of the concave-correspondence vertical wall areas 3*a* that are the areas adjacent to the concave ridges 6*a*, that is, part of the concave-correspondence vertical wall areas 3*a* is formed.

The second pressing step is then carried out. In the second pressing step, a second press apparatus is used, as shown in FIG. 2B. The second press apparatus includes a second punch 22 and a blank holder 24 as a lower die set and a second die 23 as an upper die set.

The second punch 22 reflects the shape of the area of the top plate section 2 from the convex area to the concave area and further reflects the shape of areas of the vertical wall sections 3 that are the areas adjacent to the convex ridges and the concave ridges. The second punch 22 further reflects the shape of the concave-correspondence flange areas 4*a* out of the shapes of the areas of the flange sections 4 and the shape of the area corresponding to the flat area 2*c*. The blank holder 24 reflects the shape of the convex-correspondence flange areas 4*b* out of the shapes of the areas of the flange sections 4 and the shape of the area corresponding to the flat area 2*d*.

The second die 23 reflects the shapes of the area of the top plate section 2 from the convex area to the concave area, areas of the vertical wall sections 3 that are the areas adjacent to the convex ridges and concave ridges, and the flange sections 4. In the present embodiment, the height of the shape of the concave-correspondence vertical wall areas 3*a* that the second punch 22 and the second die 23 reflect is set to be smaller than the height of the concave-correspondence vertical wall areas 3*a* of the press-formed product 1, which is the final product.

In the second pressing step, the second press apparatus is used to cause the intermediate formed product 21 to undergo draw forming. Before the second pressing step, the intermediate formed product 21 is placed between the upper and lower die sets in such a way that the convex/concave shape of the top plate section 2 fits with the shape of the lower die set. Subsequently, in the second pressing step, the second die 23 is lowered, and the second die 23 and the blank holder 24 sandwich the intermediate formed product 21. In this state, the second die 23 is further lowered. The draw forming therefore advances with tension applied to the intermediate formed product 21. The following areas are thus formed: the convex ridges 6*b*; the convex area 2*b* of the top plate section 2; areas of the convex-correspondence vertical wall area 3*b* that are the areas adjacent to the convex ridges 6*b*; and the convex-correspondence flange areas 4*b*. At the same time, the area corresponding to the flat area 2*d* out of the areas of the vertical wall sections 3 and the flange sections 4 is formed. Referring to FIG. 2B, part of the convex area 2*b* of the top plate section 2 may instead be formed in the first pressing step. The top plate section 2 of the intermediate formed product 21 may therefore have the convex/concave shape. The entire convex area 2*b* of the top plate section 2 is, however, formed in the second pressing step.

The second pressing step described above produces the intermediate formed product 31, which is the intermediate formed product in a second stage shown in FIG. 3B. The intermediate formed product 31 after the second pressing step has the following formed areas: the area of the top plate section 2 from the convex area to the concave area; areas of the vertical wall sections 3 that are the areas adjacent to the ridges 6; and the entire area of the flange sections 4. In the present embodiment, the height of the convex-correspondence vertical wall areas 3*b* of the intermediate formed product 31 after the second pressing step is slightly smaller than the height of the convex-correspondence vertical wall areas 3*b* of the press-formed product 1, which is the final product. Therefore, in the second pressing step, areas of the convex-correspondence vertical wall areas 3*b* that are the areas adjacent to the convex ridges 6*b*, that is, part of the convex-correspondence vertical wall areas 3*b* is formed.

The third pressing step is then carried out. In the third pressing step, a third press apparatus is used, as shown in FIG. 2C. The third press apparatus includes a third punch 32 as a lower die set and a third die 33 and a third pad 34 as an upper die set.

The third punch 32 reflects the shape that fully coincides with the shape of the press-formed product 1, which is the final product. The third pad 34 reflects the shape of the entire area of the top plate section 2. The third die 33 reflects the entire shape of the vertical wall sections 3 and the flange sections 4.

In the third pressing step, the third press apparatus is used to cause the intermediate formed product 31 to undergo bend forming for shape fixation. In this process, the intermediate formed product 31 is first placed between the upper and lower die sets. Subsequently, the third pad 34 is lowered to push the third pad 34 against the intermediate formed product 31 on the third punch 32. In this state, the third die 33 is lowered. More specifically, the bend forming is performed such that second ridges 7 of the vertical wall sections 3, which are the ridges opposite the ridges 6, are moved toward the outer side of the vertical wall sections 3. The second ridges 7 mean the ridges between the vertical wall sections 3 and the flange sections 4. The press-formed product 1, which is the final product, is thus formed, as shown in FIG. 3C.

In the production method according to the present embodiment, since the first pressing step, which is first carried out, is bend forming using the first pad 14, no wrinkle occurs on the concave area 2*a* or the concave-correspondence areas of the top plate section 2. In this process, the area corresponding to the convex-correspondence areas is created in a smooth shape that coincides with the convex area 2*b*. No wrinkle therefore occurs in the area corresponding to the convex-correspondence areas. Since the second pressing step, which is then carried out, is draw forming performed with tension applied to the intermediate formed product 21, which is the intermediate formed product in the first stage, no wrinkle occurs in the convex-correspondence areas (convex-correspondence vertical wall areas 3*b* and convex-correspondence flange areas 4*b* in the vicinity of the boundary between the concave-correspondence areas and the convex-correspondence areas, in particular). At this point, the concave-correspondence areas have been already created by the first pressing step carried out before. No wrinkle therefore occurs in the concave-correspondence areas. Therefore, in the production method according to the present embodiment, occurrence of wrinkles can be avoided in the production of the press-formed product 1 having a hat-shaped or groove-shaped cross section and including the top plate section 2 that rises and falls along the longitudinal direction thereof.

It is noted that what is important to avoid occurrence of wrinkles is first forming the concave-correspondence areas in bend forming and then forming the convex-correspondence areas in draw forming, as in the production method according to the present embodiment. If the order described above is reversed, wrinkles occur on the vertical wall sections and the flange sections in the vicinity of the boundary between the concave-correspondence areas and the convex-correspondence areas. A reason for this will be described below.

Figure 4A:
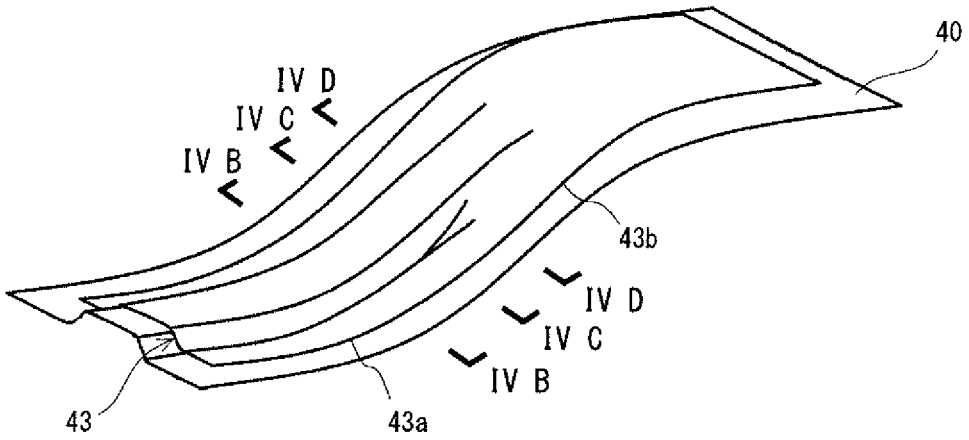
FIG. 4A is a perspective view showing the exterior appearance of an intermediate formed product after the first pressing step.
Figure 4B:
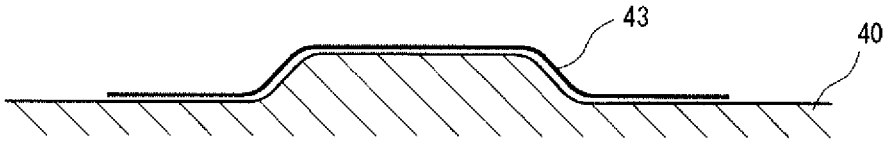
FIG. 4B is a cross-sectional view taken along the line IVB-IVB in FIG. 4A.
Figure 4C:
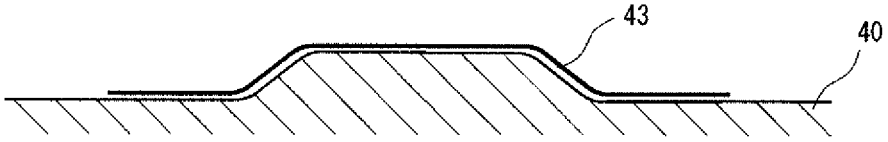
FIG. 4C is a cross-sectional view taken along the line IVC-IVC in FIG. 4A.
Figure 4D:
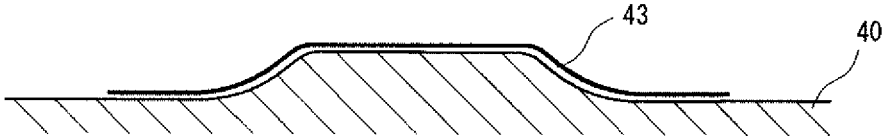
FIG. 4D is a cross-sectional view taken along the line IVD-IVD in FIG. 4A.
Figure 5:
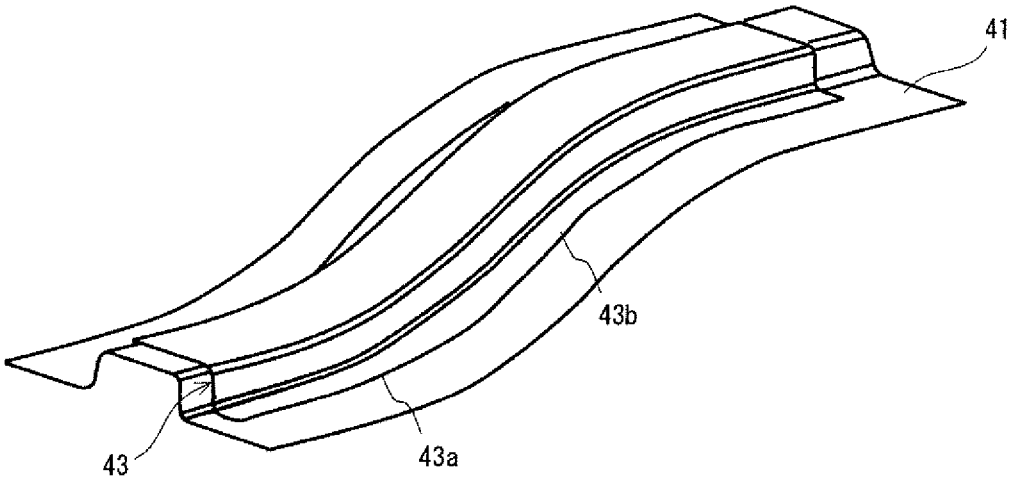
FIG. 5 is a perspective view showing the exterior appearance of the intermediate formed product after the second pressing step.

FIGS. 4A to 4D show an example after the first pressing step of the production method according to the present embodiment. FIG. 4A is a perspective view showing the exterior appearance of an intermediate formed product. FIG. 4B is a cross-sectional view taken along the line IVB-IVB in FIG. 4A. FIG. 4C is a cross-sectional view taken along the line IVC-IVC in FIG. 4A. FIG. 4D is a cross-sectional view taken along the line IVD-IVD in FIG. 4A. FIG. 5 is a perspective view showing the exterior appearance of the intermediate formed product after the second pressing step of the production method according to the present embodiment. FIGS. 4A to 5 also show lower die sets 40 and 41 for ease of understanding of the configuration of the press tooling.

Figure 6A:
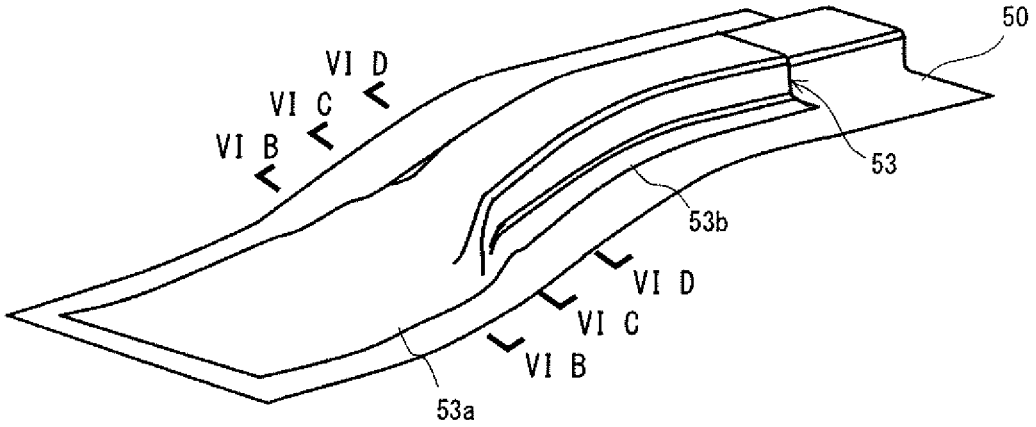
FIG. 6A is a perspective view showing the exterior appearance of a press-formed product in a case where convex-correspondence areas are first formed in draw forming.
Figure 6B:
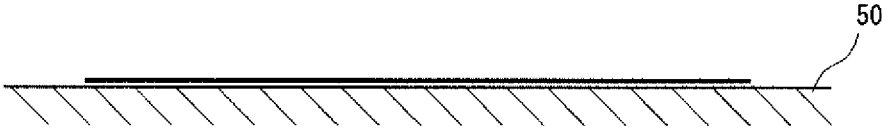
FIG. 6B is a cross-sectional view taken along the line VIB-VIB in FIG. 6A.
Figure 6C:
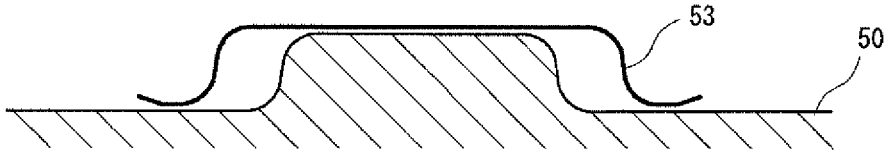
FIG. 6C is a cross-sectional view taken along the line VIC-VIC in FIG. 6A.
Figure 6D:
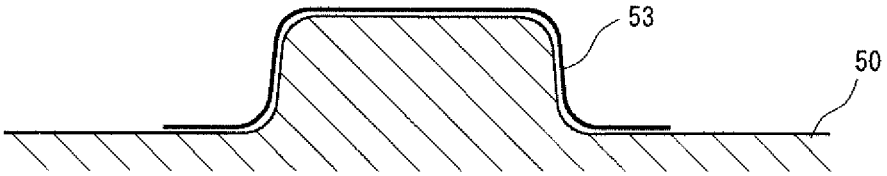
FIG. 6D is a cross-sectional view taken along the line VID-VID in FIG. 6A.
Figure 7:
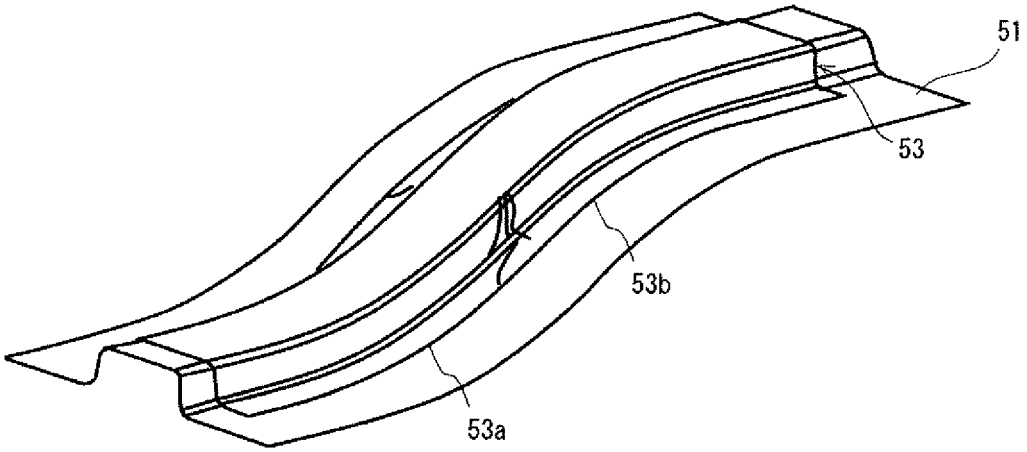
FIG. 7 is a perspective view showing the exterior appearance of the press-formed product in a case where the convex-correspondence areas are formed in draw forming and the concave-correspondence areas are then formed in bend forming.

FIGS. 6A to 6D show an example in the case where the convex-correspondence areas are first formed in draw forming. FIG. 6A is a perspective view showing the exterior appearance of the press-formed product. FIG. 6B is a cross-sectional view taken along the line VIB-VIB in FIG. 6A. FIG. 6C is a cross-sectional view taken along the line VIC-VIC in FIG. 6A. FIG. 6D is a cross-sectional view taken along the line VID-VID in FIG. 6A. FIG. 7 is a perspective view showing the exterior appearance of the press-formed product in the case where the convex-correspondence areas are formed in draw forming and the concave-correspondence areas are then formed in bend forming. FIGS. 6A to 7 also show lower die sets 50 and 51 for ease of understanding of the configuration of the press tooling.

In the case where the convex-correspondence areas are first formed in bend forming, as in the production method according to the present embodiment, vertical wall sections 43 overhang in the vicinity of the boundary between concave-correspondence areas 43*a* and convex-correspondence areas 43*b*, as shown in FIGS. 4A to 4D. The amount of the overhangs is relatively small. Therefore, when the convex-correspondence areas are then formed in draw forming, the overhangs of the vertical wall sections 43 are formed with appropriate tension applied thereto. No wrinkle therefore occurs in the vicinity of the boundary between the concave-correspondence areas 43*a* and the convex-correspondence areas 43*b*, as shown in FIG. 5.

In contrast, in the case where the convex-correspondence areas are first formed in draw forming, vertical wall sections 53 overhang in the vicinity of the boundary between concave-correspondence areas 53*a* and convex-correspondence areas 53*b*, as shown in FIGS. 6A to 6D. The amount of the overhangs is relatively large because the forming is performed with tension applied to the blank plate. If the concave-correspondence areas are then formed in bend forming, the overhangs of the vertical wall sections 53 are restricted in the same position. Wrinkles therefore occur in the vicinity of the boundary between the concave-correspondence areas 53*a* and the convex-correspondence areas 53*b*, as shown in FIG. 7.

Therefore, to avoid occurrence of wrinkles, it is important to first form the concave-correspondence areas in bend formation and then form the convex-correspondence areas in draw forming, as in the production method according to the present embodiment.

The material of the press-formed product 1 in the present embodiment can be a steel plate having yield strength (YS) of 400 MPa or more. The press-formed product 1 is more preferably is formed of a steel plate having yield strength (YS) of 600 MPa or more. A reason for this is as follows: A material having low yield strength tends to be plastically deformed with low stress. An area where wrinkles occur in press forming using press tooling is therefore plastically deformed and follows the press tooling, and wrinkles are therefore unlikely to occur. On the other hand, a material having high tensile strength is unlikely to be plastically deformed, and wrinkles therefore tend to occur.

The blank plate formed into the press-formed product 1 in the present embodiment can be a steel plate having a plate thickness ranging from 0.8 to 1.6 mm. Further, the press-formed product 1 in the present embodiment can satisfy the conditions expressed by Formulae (1) to (6) described above, which are conditions under which wrinkles tend to occur.

Further, needless to say, the present invention is not limited to the embodiment described above and can be changed in a variety of manners to the extent that the changes do not depart from the substance of the present invention. For example, in the embodiment described above, dimensions of the punches and dies used in the first and second pressing steps are set such that the height of the concave-correspondence vertical wall areas of the intermediate formed product after the second pressing step is smaller than the height of the concave-correspondence vertical wall areas of the press-formed product, which is the final product. In contrast, dimensions of the punches and dies used in the first and second pressing steps may be set such that the height of the convex-correspondence vertical wall areas of the intermediate formed product after the second pressing step is smaller than the height of the convex-correspondence vertical wall areas of the press-formed product, which is the final product. In both cases, the third pressing step is required.

Dimensions of the punches and dies used in the first and second pressing steps may instead be set such that the height of the entire area of the vertical wall sections of the intermediate formed product after the second pressing step coincides with the height of the entire area of the vertical wall sections of the press-formed product, which is the final product. In this case, the third pressing step can be omitted.

In the embodiment described above, the press-formed product has a hat-shaped cross section over the entire area in the longitudinal direction. The entirety or part of the press-formed product may instead have a groove-like cross-sectional shape with no flange. In the present disclosure, since the concave-correspondence areas or the flat area does not need to undergo draw forming with a blank holder, even a press-formed product having a groove-shaped cross section has no particular problem, such as wrinkles. Further, the convex-correspondence areas are caused to undergo draw forming with the blank holder. The draw forming may be fully performed to the point where no flange is present in the vicinity of the bottom dead center in the forming, or a groove-like cross-sectional shape may be created after the steps in the present embodiment by cutting the press-formed product with trimming press tooling or laser cutting.

In the embodiment described above, the third press apparatus used in the third pressing step includes the punch, the die, and the pad. The pad of the third press apparatus may instead be integrated with the die.

In the first to third press apparatuses, the arrangement of the upper and lower die sets may be reversed upside down.

Example

To confirm the effect of the production method according to the present embodiment, computer simulations assuming production of the press-formed product shown in FIG. 1A were conducted. In Inventive Example of the present invention, the concave-correspondence areas were first caused to undergo bend forming, and the convex-correspondence areas were then caused to undergo draw forming (see FIGS. 2A to 2C). In Comparative Example 1, the press-formed product was formed in one pressing step. In Comparative Example 2, the convex-correspondence areas were first caused to undergo draw forming, and the concave-correspondence areas were then caused to undergo bend forming (see FIGS. 6A to 7). In each of the simulations, the strain in the press-formed product was analyzed to evaluate whether or not wrinkles have occurred.

In each of the simulations, the various conditions were set as follows: The yield strength YP of the blank plate was 843 MPa; the plate thickness of the blank plate was 1.80 mm; the radius of curvature of the concave ridges was 500 mm; the central angle θa of the concave ridges was 38°; the height Ha of the concave-correspondence vertical wall areas was 30 mm; the radius of curvature Rb of the convex ridges was 500 mm; the central angle θb of the convex ridges was 38°; the height Hb of the convex-correspondence vertical wall areas was 50 mm; and the linear distance L from the center of each of the concave ridges to the center of the corresponding convex ridge was 300 mm.

Wrinkles were determined to have occurred when the result of each of the simulations showed that the magnitude of decrease in the plate thickness was −0.18 or less (increase in plate thickness).

Table 1 shows the results of the simulations in the present example. In Table 1, the letter "E (Excellent)" means that no wrinkle occurred. In Table 1, the letter "NA (Not Acceptable)" means that wrinkles occurred.

TABLE 1

| Category | Inventive Example of present invention | Comparative Example 1 | Comparative Example 2 |
|---|---|---|---|
| Evaluation | E | NA | NA |

Referring to Table 1, no wrinkle occurred in Inventive Example of present invention. Wrinkles occurred in Comparative Examples 1 and 2.

INDUSTRIAL APPLICABILITY

The method for producing a press-formed product according to the present disclosure can be effectively used to produce a press-formed product for an automobile required to be a high-strength part.

REFERENCE SIGNS LIST

1: Press-formed product
2: Top plate section
2*a*: Concave area
2*b*: Convex area
2*c*: Flat area
2*d*: Flat area
3: Vertical wall section
3*a*: Concave-correspondence vertical wall area
3*b*: Convex-correspondence vertical wall area
4: Flange section
4*a*: Concave-correspondence flange area
4*b*: Convex-correspondence flange area
6: Ridge
6*a*: Concave ridge
6*b*: Convex ridge
11: Blank plate
12: First punch
13: First die
14: First pad
21: Intermediate formed product
22: Second punch
23: Second die
24: Blank holder
31: Intermediate formed product
32: Third punch
33: Third die
34: Third pad

The invention claimed is:

1. A method for producing an intermediate formed product, the intermediate formed product to be further processed into a press-formed product, the production method comprising:

placing a blank metal plate in such a way that the blank metal plate extends off opposite sides of a vertex of a first punch;

causing the blank plate to undergo bend forming by using the first punch, a pad, and a first die in such a way that concave ridges, a concave area, and areas of concave-correspondence vertical wall areas that are areas adjacent to the concave ridges are formed in the blank plate to produce an initial intermediate formed product; and causing the initial intermediate formed product to undergo draw forming by using a second punch, a second die, and a blank holder in such a way that convex ridges, a convex area, areas of convex-correspondence vertical wall areas that are areas adjacent to the convex ridges, and second ridges located opposite the concave and convex ridges are formed in the initial intermediate formed product to form the intermediate formed product, the second ridges being part of vertical wall sections having the concave-correspondence vertical wall areas adjacent to the concave ridges and the convex-correspondence vertical wall areas adjacent to the convex ridges.

2. A method for producing a press-formed product comprising:

providing an intermediate formed metal product, the intermediate formed metal product comprising:

concave ridges, a concave area, and areas of concave-correspondence vertical wall areas that are areas adjacent to the concave ridges; and convex ridges, a convex area, areas of convex-correspondence vertical wall areas that are areas adjacent to the convex ridges, and additional ridges located opposite the concave and convex ridges, the additional ridges being part of vertical wall sections having the concave-correspondence vertical wall areas adjacent to the concave ridges and the convex-correspondence vertical wall areas adjacent to the convex ridges, and a top plate section between the convex ridges and concave ridges, and performing bend forming on the intermediate formed metal product, the bend forming moving the additional ridges of the vertical wall sections toward an outer side of the vertical wall sections to form the press-formed product, the press-formed product including:

the top plate section located between the convex ridges and concave ridges, the vertical wall sections extending from the top plate section via the convex ridges and concave ridges, each of the concave ridges convexly curved toward an inner side of the corresponding vertical wall section and each of the convex ridges convexly curved toward the outer side of the corresponding vertical wall section, a linear distance between a center of each of the concave ridges and a center of the corresponding convex ridge being 15 times a spacing between the convex ridges and concave ridges or less, the top plate section having the concave area located between the concave ridges and the convex area located between the convex ridges, the vertical wall sections having the concave-correspondence vertical wall areas adjacent to the concave ridges and the convex-correspondence vertical wall areas adjacent to the convex ridges, the additional ridges located in positions opposite the convex ridges and concave ridges.

3. The method for producing an intermediate formed product according to claim 1, wherein the blank plate is a steel plate, and yield strength of the blank plate is 400 MPa or more.

4. The method for producing an intermediate formed product according to claim 1, wherein the blank plate is a steel plate, and yield strength of the blank plate is 600 MPa or more.

5. The method for producing an intermediate formed product according to claim 1, wherein a plate thickness of the blank plate ranges from 0.8 to 1.6 mm.

6. The method for producing an intermediate formed product according to claim 1, wherein a following Formula (6) is satisfied:

$$0.011<t/W<0.032 \quad (6)$$

where symbols in the Formula mean as follows:

t [mm] represents a plate thickness of the blank plate;

W [mm] represents a spacing between the two ridges.

* * * * *